United States Patent [19]

Erdberg

[11] Patent Number: 4,919,630

[45] Date of Patent: Apr. 24, 1990

[54] INBOARD DRIVE SYSTEM FOR A MARINE CRAFT

[76] Inventor: Adam Erdberg, 3205 N.E.188 St., North Miami Beach, Fla. 33180

[21] Appl. No.: 371,140

[22] Filed: Jun. 26, 1989

Related U.S. Application Data

[63] Continuation-in-part of Ser. No. 613,441, May 24, 1984, abandoned.

[51] Int. Cl.[5] ..... B63H 21/26

[52] U.S. Cl. ..... 440/79; 440/82; 440/111; 114/163

[58] Field of Search ..... 114/162, 163, 144 R; 440/75, 80, 79, 82, 83, 112, 51, 81, 111

[56] References Cited

U.S. PATENT DOCUMENTS 4,383,829 5/1983 Allen, Jr. et al. ..... 440/75

FOREIGN PATENT DOCUMENTS 2855568 1/1980 Fed. Rep. of Germany ..... 440/75

OTHER PUBLICATIONS

Tower Hobbies Catalog, p. 117; K & B Double Rudder Assembly Copyright 1983.

*Primary Examiner*—Joseph F. Peters, Jr.
*Assistant Examiner*—Edwin L. Swinehart
*Attorney, Agent, or Firm*—Malloy & Malloy

[57] ABSTRACT

The present invention is directed towards a drive system for a marine craft of the type wherein the power plant or drive engine is located inboard of the craft and the overall craft is designed for high performance operation. The system includes twin drive engines preferably of the diesel type mounted in spaced relation to the stern of the craft. Two elongated straight line drive shaft extend from a driving interconnection with separate ones of the engines rearwardly so as to have respective distal ends located outboard of the craft and be oriented to pass through the transom such that the drive shafts are maintained at a predetermined angular orientation sufficient to position propeller structures at a substantially optimum surface piercing position relative to the static water line. A T-shaped steering strut assembly projects outwardly from the transom and supports a portion of the steering assembly and two cooperatively positioned rudder elements each disposed in aligned relation with a respective ones of the propellers.

6 Claims, 5 Drawing Sheets

INBOARD DRIVE SYSTEM FOR A MARINE CRAFT

BACKGROUND OF THE INVENTION

This is a continuation-in-part application of patent application Ser. No. 613,441 filed on May 24, 1984.

FIELD OF THE INVENTION

This invention is directed to an inboard drive system for a marine craft capable of providing a fixed optimum position for the drive shafts and accompanying driven propeller structures such that complex inboard-outboard drive assemblies are eliminated and heavy duty, high torque drive engines or power plants such as diesel engines may be utilized.

DESCRIPTION OF THE PRIOR ART

Typically, inboard drive assemblies for speed boats and other large but high performance oriented marine craft include a power plant or drive engine drivingly interconnected to a drive shaft which penetrates the bottom of the boat and orients the propeller at a position relative to the static water line of the craft which is less than totally desirable. Aternately, outboard drive systems are incorporated using hydraulic pumps, lifts, circuitry, etc. so as to allow adjustability of the angle or position of the driving propeller in the water relative to the stern of the craft depending upon the load factors and operating performance characteristics for which the craft is intended. In the latter structures, the position of the propeller may be varied depending upon what performance is desired of the craft during a particular period of operation. One problem associated with outboard drive systems of the type described above is their complex nature and plurality of components requiring that such drive systems cannot be kept, along with the marine craft, in the water for extended periods. Such an outdrive system includes seals, bearings, and like parts which easily corrode and/or become inoperative when exposed for extended periods to salt water. Accordingly, such marine craft incorporating such outdrive systems must be frequently removed from the water or otherwise be subject to frequent and expensive maintenance of the outdrive system.

Another problem associated with such outdrive system is the inability of the drive shaft used to rotate the propeller having sufficient strength to adapt to the torque generated by larger, more powerful diesel engines. In many marine applications, the diesel engine is preferred because of its reliability, relative economy and the amount of power or torque generated. The complicated outdrive system is simply not equipped to handle the high torque of such increased power takeoff in addition to having the inherent disadvantage of maintenance problems for the reasons set forth above.

In the above-mentioned prior art design wherein the drive shaft penetrates the bottom of the boat, heavy duty power plants such as diesel engines are allowed to be utilized which locate the diesel engine closer than normal to midship. Such location has particular advantages.

In the U.S. Pat. No. 4,383,829, to Allen, an inboard drive assembly is disclosed wherein a drive motor is located substantially adjacent to the transom of the boat and a power take-off shaft is oriented in driving interconnection from the power plant and attached to a "V-drive" assembly which is known in the prior art. A primary drive shaft then interconnects the V-drive assembly with the propeller which is mounted to rotate with the distal end of the primary drive shaft. Utilizing such a structure, the drive shaft is allowed to penetrate the transom portion of the boat and the driving propeller is in fact located at a more desirable "optimum" position for efficient driving of the craft relative to a static water line dependent upon load factors as well as the power capabilities of the driving engine. The center of gravity of the craft is of course located closer to the stern portion than midship due to the weight of the engine. However, in order to arrange the driving propeller at the desired "optimum" angle or position, the Allen structure must incorporate a one or two speed forward, step-up V-gear assembly with a hydraulic transmission which serves to connect the engine shaft and the propeller shaft at the V-drive structure. The above structure of Allen while certainly operative may be considered less than totally desirable for certain applications in that it incorporates the additional transmission features and requires the step-up gearing of the V-drive when utilizing a high performance inboard engine.

Other patents representing prior art drive assemblies and marine craft design incorporating the same are set forth in the U.S. Pat. Nos. 2,022,652; to Fahrney et al, Galuska, 3,177,841; Satterthwaite et al, 3,407,779; and Ludlow, 4,428,734. Also of note is the German Pat. No. 2,855,568 to Hurth directed to a transmission system for an inboard engine marine craft. However, Hurth specifically discloses a structure including a one-piece casting which incorporates support for an outboard shafting and rudder support as well as controls. A hollow casting 2 is part of the horizontally extending box girder 4 wherein these parts respectively support the drive shaft for the propeller and the rudder and steering controls. Hurth emphasizes a one-piece casting for outboard shafting and rudder support thereby teaching away from what may be considered a preferred structure of an independently supported strut relative to cooperative but independent structure of a steering strut and/or a T-shaped housing.

The above set forth prior art marine craft drive assemblies and overall designs are certainly operative for the intended application. However, there is still a recognized need in the boating industry for a drive system which allows a heavy duty power plant including a pair of diesel engines of high torque capability each utilized to directly drive a linear, in-line drive shaft disposed at a predetermined angular orientation. This orientation of the drive shafts penetrates the transom at the stern of the craft and thereby positions the driving propeller mounted on the distal end of each shaft at a substantially fixed and optimum surface piercing position relative to the water line during operation or travel of the craft. A boat equipped and designed in this manner can therefore be much larger and include a much more powerful driving engine or facility than existing high performance boats in that such a craft will not require the utilization of any adjustable outdrive and therefore is not restricted by the limitation of any outdrive torque capacity or maintenance requirements.

SUMMARY OF THE INVENTION

The present invention comprises a drive assembly for a marine craft wherein drive means includes two drive engines located inboard of the craft and each disposed in driving interconnection with individual elongated in-line drive shafts. In the present invention, the two drive engines are preferably heavy duty diesel engines of high torque capability and extended operable life known for their reliability. While preferred in many marine craft applications, such heavy duty drive engines require an accompanying drive shaft capable of withstanding the high output torque requirements existing when utilizing such diesel engines. The drive shafts are directly attached to respective drive engines by a power take-off coupling wherein the drive engines include a standard transmission. Position of each of the drive engine is such as to dispose its drive shaft at a predetermined angular orientation such that its distal end, to which a driving propeller is secured, is located outboard of the craft at a substantially "optimum" position relative to the static water line of the craft. The referred to "optimum" position is that angle or position at which the propeller is positioned and oriented relative to the static water line of the craft, or the water surface, based on certain load characteristics and power ratings of the drive engines. Further, the optimum position allows the most efficient performance of the propeller at all speed ranges of the given power plant or drive engine means utilized to power the craft and is further defined to dispose the craft in a surface piercing position during travel of the craft through water. An important feature of the present invention is that maintenance of the propeller at such a optimum position is accomplished by orienting the drive shaft at a predetermined angle relative to its point of interconnection to a respective drive engine. This allows the drive shaft to penetrate and extend through the transom at the stern portion of the craft and specifically avoids passage of the drive shaft through the bottom of the boat. Accordingly, penetration and passage of the drive shaft through the transom portion of the craft at the stern thereof positions the driving propeller in the aforementioned optimum position without resorting to the complexities and attendant maintenance scheduling commonly associated with an outdrive system. Since the optimum position of the driving propeller is already maintained through the straight, in-line orientation of the drive shaft from the power takeoff of the engine through the transom, the adjustability advantages of the outdrive system are no longer required.

The subject drive system eliminates the requirement for any step-up gearing, V-drive, or multiple forward speed gearings and allows the drive engine means to substantially face the stern of the craft. Such a design further enables positioning of the drive engine means closer to midship and in a spaced, relatively remote location from the transom at the stern of the craft. This has the effect of transferring the center of gravity of the craft towards midship which is substantially contrary to typical or prior art design characteristics for high performance boats. The location of the center of gravity substantially closer to the midship position allows improved planing capabilities and softens the ride of the craft in rough seas.

The subject drive system thereby enables a relatively large high performance boat to be capable of heavy duty application by allowing the use of very reliable, high torque engines such as diesel engines. Such high torque power plants could not be utilized previously because of the torque limitations inherently existing in outdrive systems designed to vary the angle or position of the driving propeller relative to the static water line dependent upon the performance demands.

With the present invention, a variable propeller shaft angle or position commonly used in any outdrive application is effectively eliminated. Therefore, there is no need or requirement for hydraulic components, hoses, pumps, electrical circuitry, seals, bearings, etc. normally associated with such outdrive systems. The drive shaft and attached propeller of the present invention is disposed at the aforementioned and defined optimum angle thereby allowing excellent performance characteristics throughout the speed range of the power plant and marine craft.

Additional structural features of the present invention comprise the provision of support means in the form of support struts secured to the stern and/or transom portion of the craft outboard thereof and extending outwardly and downwardly in depending relation to the stern. These struts engage and support the respective drive shafts as they exit the transom. This serves to maintain the distal end of the drive shaft and of course the driving propeller attached thereto at the aforementioned optimum angle and position one extending out from the transom The present invention further comprises the provision of a steering strut means in the form of a T-strut having a base portion secured outboard of and in outwardly extending and depending relation to the stern of the craft. The steering strut means is spaced from and structured independently of the support struts and includes rudder means disposed in aligned relation behind the respective driving propeller. The steering strut means further includes a housing used to enclose and mount a portion of the remainder of the steering assembly including tiller arms, tie bar and steering activation structure associated with the manipulation of each of the rudder structures relative to the respective driving propellers.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
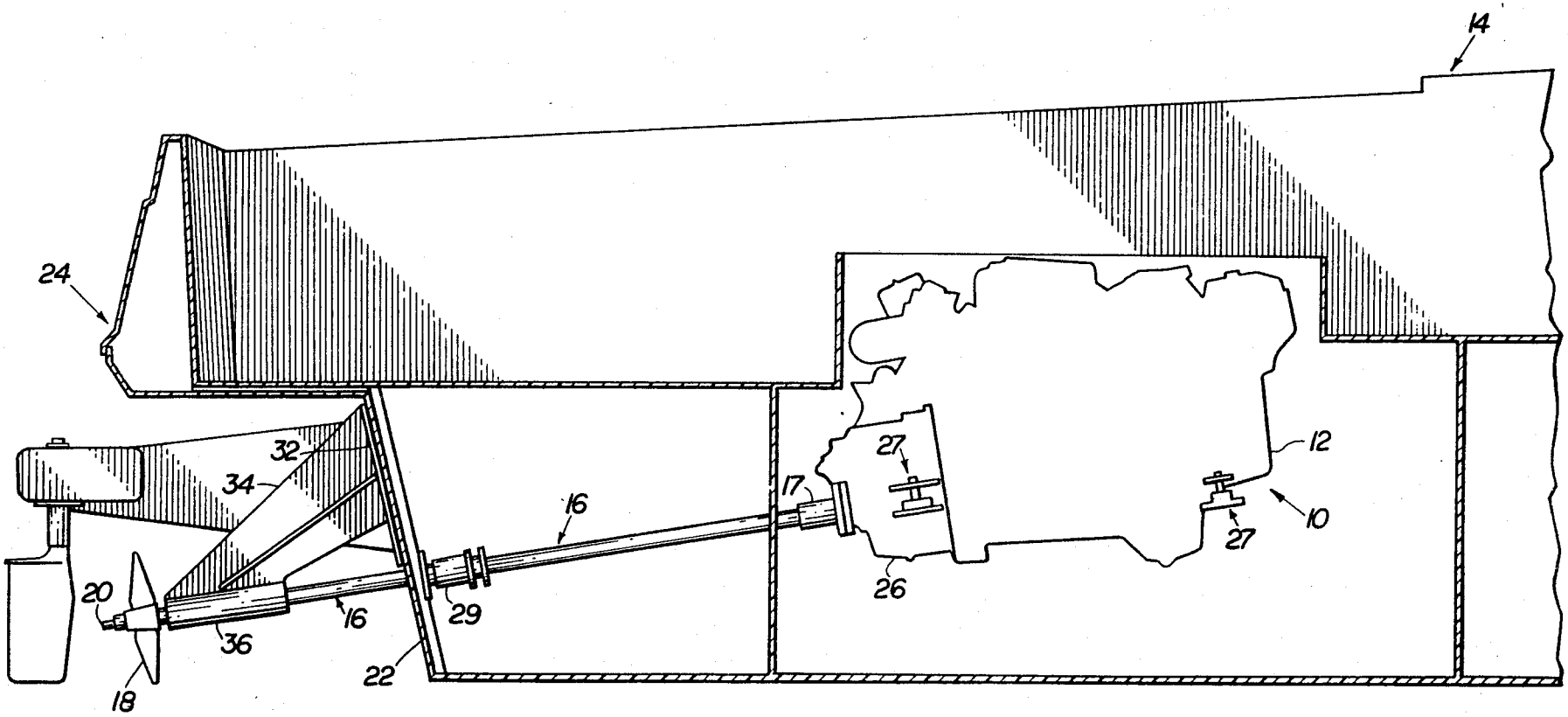
FIG. 1 is a sectional view showing inboard and outboard positioning of the drive assembly of the present invention mounted on a marine craft.

As best shown in FIGS. 1, 2, 3, 7 and 8, the drive system of the present invention comprises a drive means generally indicated as 10 in the form of at least one and preferably two drive engines 12 wherein the drive engines are located inboard of a marine craft generally indicated as 14. Each of the drive engines 12 are drivingly attached to rotate a drive shaft means generally indicated as 16. Each of the drive shafts being driven from respective drive engines, such as drive engine 13, has an elongated configuration and an in-line displacement extending from a power coupling 17 to a driving propeller 18 located at the distal end 20 of the drive shaft 16. As shown best in FIGS. 2 and 3, the present drive system preferably comprises two drive shafts 16 and 16' each interconnected to respective drive motors. However, for purposes of clarity a single drive engine 12 will be primarily referred to and described in cooperative relation to its respective drive shaft 16 and drive propeller 18. However, it should be emphasized that when two drive engines are shown there are of course separate respective drive shafts 16 and 16' and drive propellers 18 and 18' attached to respective distal ends 20 and 20' of the drive shafts.

Figure 7:
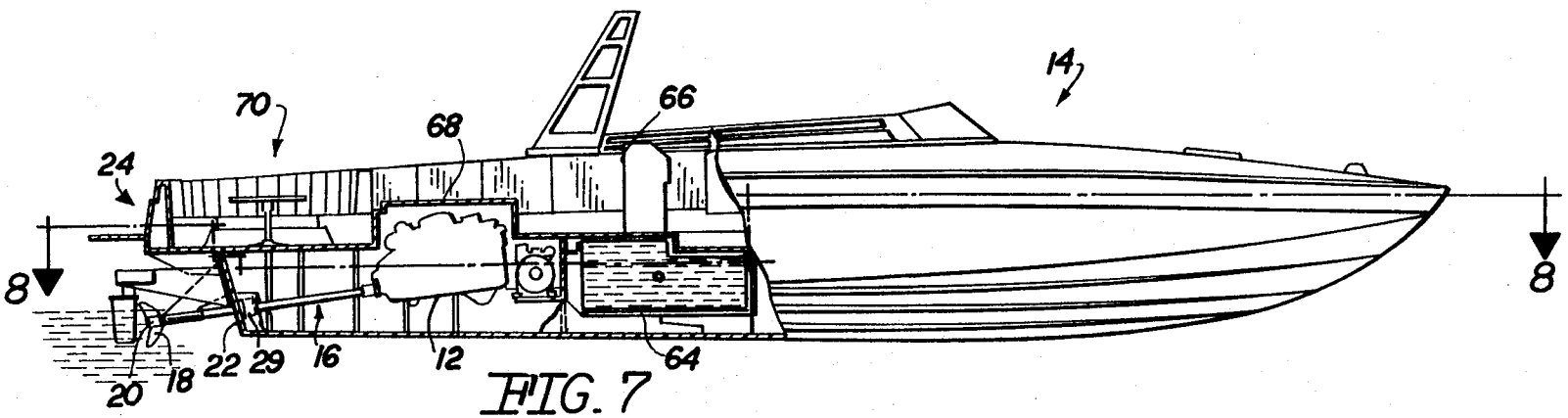
FIG. 7 is a longitudinal side view in partial cutaway and section showing interior details of the marine craft incorporating the drive system of the present invention.

The drive system of the present invention is designed as an inboard drive system wherein the drive engine 12 is located inboard of marine craft 14 and in substantially remote spaced relation to transom 22 located at the stern generally indiated as 24 of the marine craft 14. An important feature of the present invention is the disposition of the drive engine 12 closer to midship of craft 14 and in spaced relation to the transom 22 (see FIGS. 7 and 8). Further, the drive engines 12 are disposed in facing relation to the transom 22 such that a straight in-line orientation and positioning of the drive shaft means 16 is provided. This allows "optimum" positioning of the distal end 20 and the attached drive propeller 18 relative to a static waterline. Such "optimum" positioning of the propeller 18 is accomplished by extension of the drive shaft 16 through the transom 22 for its outboard positioning as clearly shown in FIGS. 1, 2, and 3 and 7. The aforementioned optimum position of the propeller, as set forth herein, is such as to accomplish positioning of the propeller, during operation and travel of the craft 14 in a water piercing and accordingly more efficient location. It is accepted that a surface piercing propeller produces less drag and accordingly operates in a more efficient manner. This is further accomplished by the provision of a standard transmission means 26 attached in driving connection with the drive engine 12 and in interconnecting relation between the drive shaft 16 and the drive engine 12. The orientation of the drive engine 12 along with transmission 26 and power coupling 17 in a facing relation relative to the transom 22 eliminates the requirement for any V-drive assembly and the attendant need for a primary and secondary drive shaft and power take-off shaft. Further, mounting means 27 are provided to secure the engine 12 at the closer to midship location (see FIGS. 1, 7 and 8) such that the drive shaft is angularly oriented relative to the longitudinal axis of the marine craft. This angular orientation allows extension of the distal end 20 of the drive shaft 16 into its outboard position by penetrating the transom 22 a the stern 24 of marine craft 14 rather than penetrating the bottom of the marine craft as is conventional with prior art marine design. It should also be emphasized that orientation of the drive shaft such that it passes through the bottom of the craft 14 rather than the preferred transom location would result in it being impossible to dispose the propeller 18 in the aforementioned optimum position so as to accomplish a surface piercing orientation when the craft is travelling through the water. Therefore, the straight line configuration of the drive shaft 16 and its angular orientation from a facing motor and transmission assembly 12 and 26 respectively allows for the aforementioned and preferred transom penetration as best shown in FIGS. 1 and 7.

Figure 2:
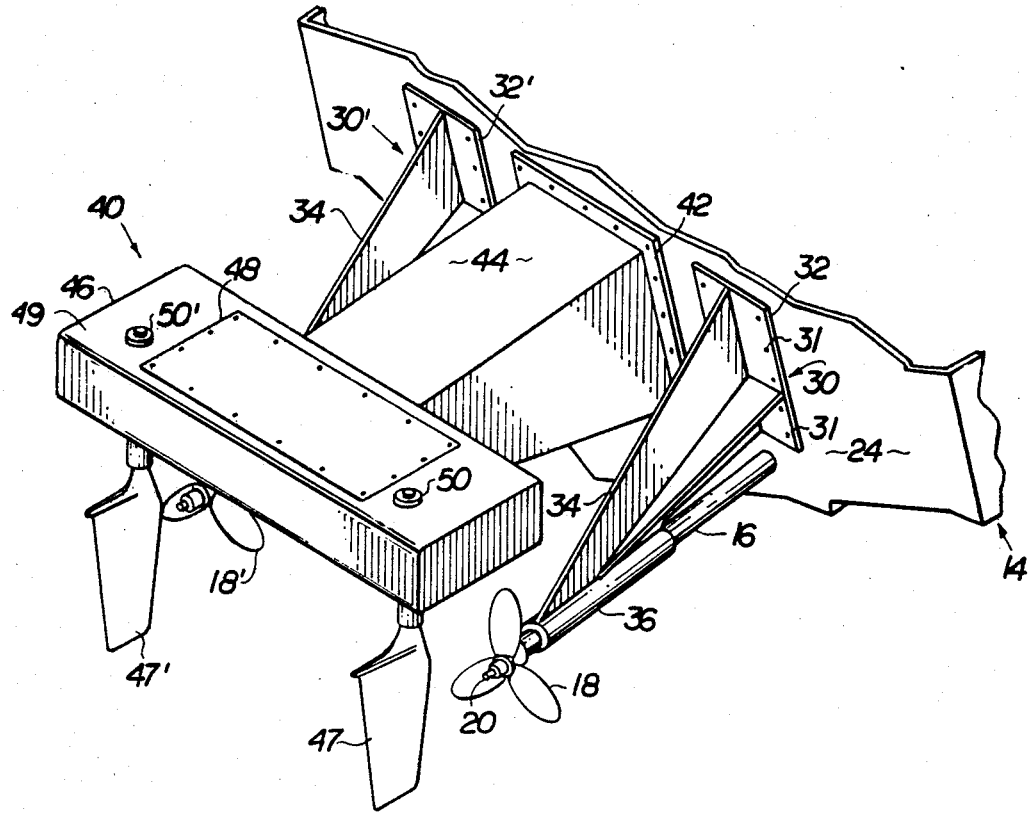
FIG. 2 is an isometric view of an outboard portion of the subject assembly relative to its relation to the transom at the stern portion of the marine craft.
Figure 3:
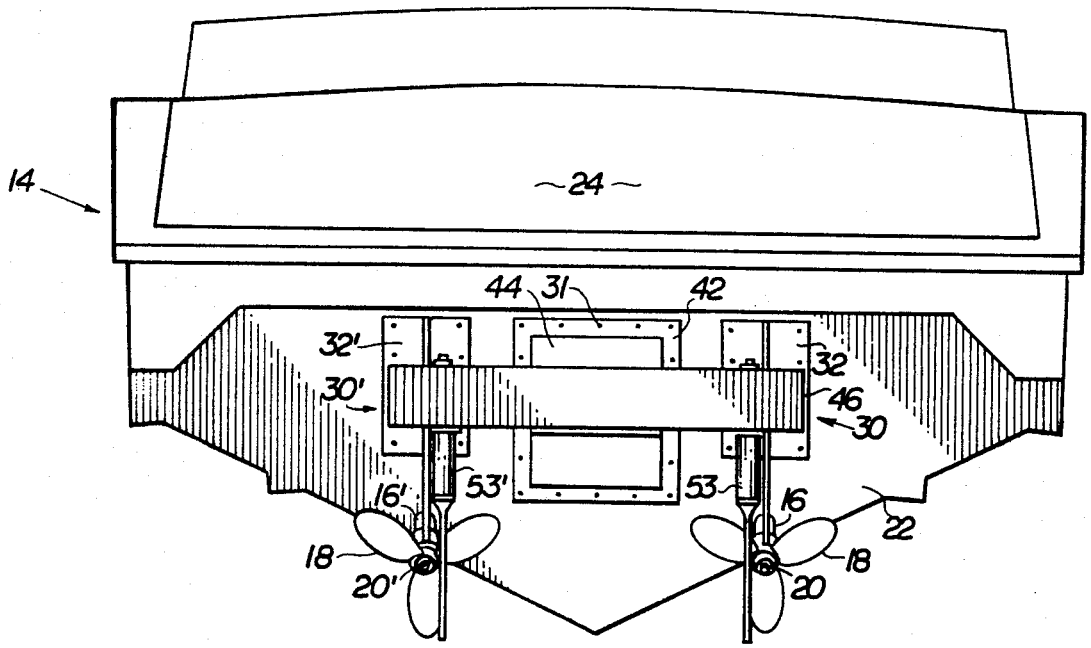
FIG. 3 is an end view of the embodiment of FIG. 3.

Other structural features of the present invention as best shown in FIG. 2 includes supporting means in the form of individual support struts generally indicated as 30 and 30'. The support struts 30 and 30' are fixedly secured to the stern 24 of the marine craft 14 by proper connectors 31 interconnecting base plate 32 and 32' to the exterior sur face of the transom 22. The support struts 30 and 32' include outwardly extending leg portions 34 terminating in sleeve member 36 having an internal bearing which allows rotation of the drive shaft 16 relative to the sleeve 36 and the overall support struts 30 and 30'. The distal end 20 of the drive shaft 16 and the attached driving propeller 18 is thereby maintained in the aforementioned optimum position relative to the waterline of the marine craft 14 to accomplish efficient results over a variety of speed ranges and performance characteristics of the drive engine 12.

Figure 4:
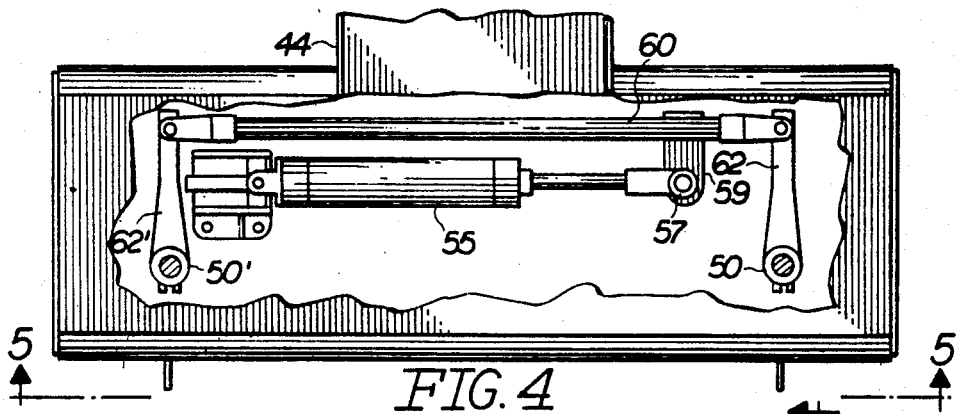
FIG. 4 is a top view in partial cutaway showing internal components of the steering assembly mounted within a T-strut portion of the drive system of the present invention.
Figure 5:
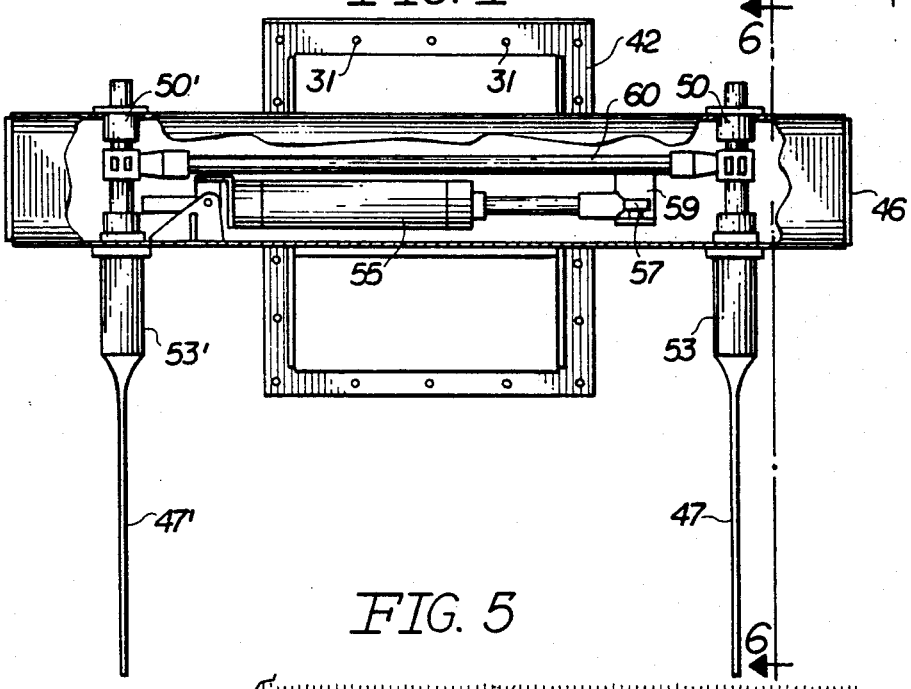
FIG. 5 is an end view in partial cutaway of the embodiment of FIG. 4.
Figure 6:
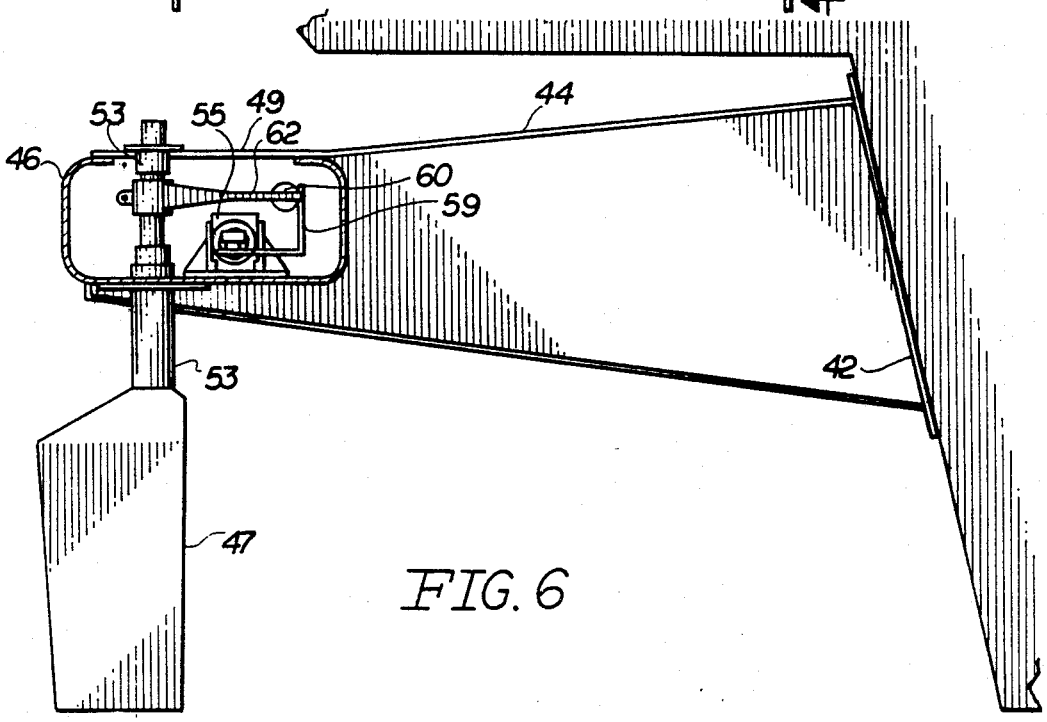
FIG. 6 is a side view in partial cutaway of the embodiment of FIGS. 4 and 5.

Other structural features of the present invention comprise a steering strut means generally indicated as 40 secured by base plate 42 to the transom portion 22 of marine craft 14 so as to extend outwardly therefrom. The steering strut 40 includes a support leg 44 and a housing 46 secured to the distal end of the support leg 44 so as to define a substantially T-shaped configuration. An access plate 48 is secured to an exposed surface 49 of the housing 46 so as to provide access to the interior housing 46 and components of the steering assembly disposed therein. The steering assembly includes in part two rudder elements 47 and 47' mounted in depending relation from the housing 46 to which they are journaled as at rudder bearing assembly 50 and 50'. With reference to FIGS. 4, 5 and 6 the rudders 47 and 47' are interconnected in depending relation to the housing 46 by respective rudder posts 53 and 53'. Additional components of the steering assembly include activating steering cylinder 55 including a hydraulic piston and cylinder assembly which is pivotally interconnected as at hinge or pivot connection 57 and connecting link 59 to tie bar 60. The tie bar is pivotally attached to interconnect the respective tiller arms 62 and 62' interconnected to the rudder ports 53 and 53' and the rudder elements 47 and 47'.

Accordingly, the steering strut 40 is located in spaced relation between the supporting struts 30 and 30' and structured independently thereof to extend outwardly from the transom 22. In such a position the individual rudder elements 47 and 47' are located in aligned position behind the respective driving propellers 18 and 18' to provide steering action.

Figure 8:
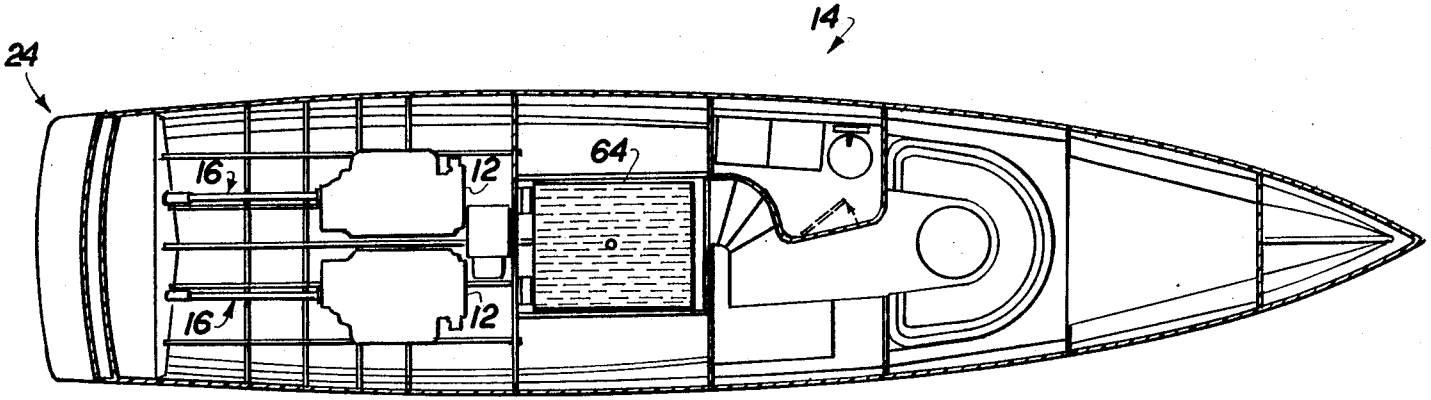
FIG. 8 is a sectional view along line 8—8 of FIG. 7.

To better emphasize, placement of the engines 12 are shown clearly in FIGS. 7 and 8. As disclosed, the engines 12 are located in spaced relation to the stern 24 and closer to mid ship or more specifically the center of gravity of the craft. In such location, each of the motors 12 effectively "face" the stern to accomplish a straight line interconnection of the individual drive shafts 16 and 16' as such straight line drive shafts are angularly oriented to extend specifically through the transom 22 at the stern 24 of craft 14 and outwardly therefrom for placement of the driving propellers 18 on the distal end of the drive shafts 16 and 16' at the aforementioned and defined optimum location. Accordingly, an important feature of the present invention is is elimination of any type of V drive system wherein in typical prior art constructions, the motors are effectively facing in the opposite direction to that shown in FIGS. 7 and 8 and a supplementary drive shaft drive shaft or interconnecting shaft is used to dringingly interconnect the engine and power takeoff to the drive shaft. In such prior art devices totally incorporating an inboard engine, the drive shafts extend generally through the bottom of the boat thereby making it difficult or impossible for placement of the driving propellers 18 in the aforementioned optimum position so as to be surface piercing when the craft is in movement. For purposes of clarity, other structural features of the craft 14 include the fuel tank 64, control panel 66, motor housing 68, and leisure area 70. The leisure area 70 is of course provided for occupants of the craft 14 but is generally located where normal prior art engines would be located in conventional inboard craft not incorporating a V drive.

Figure 9:
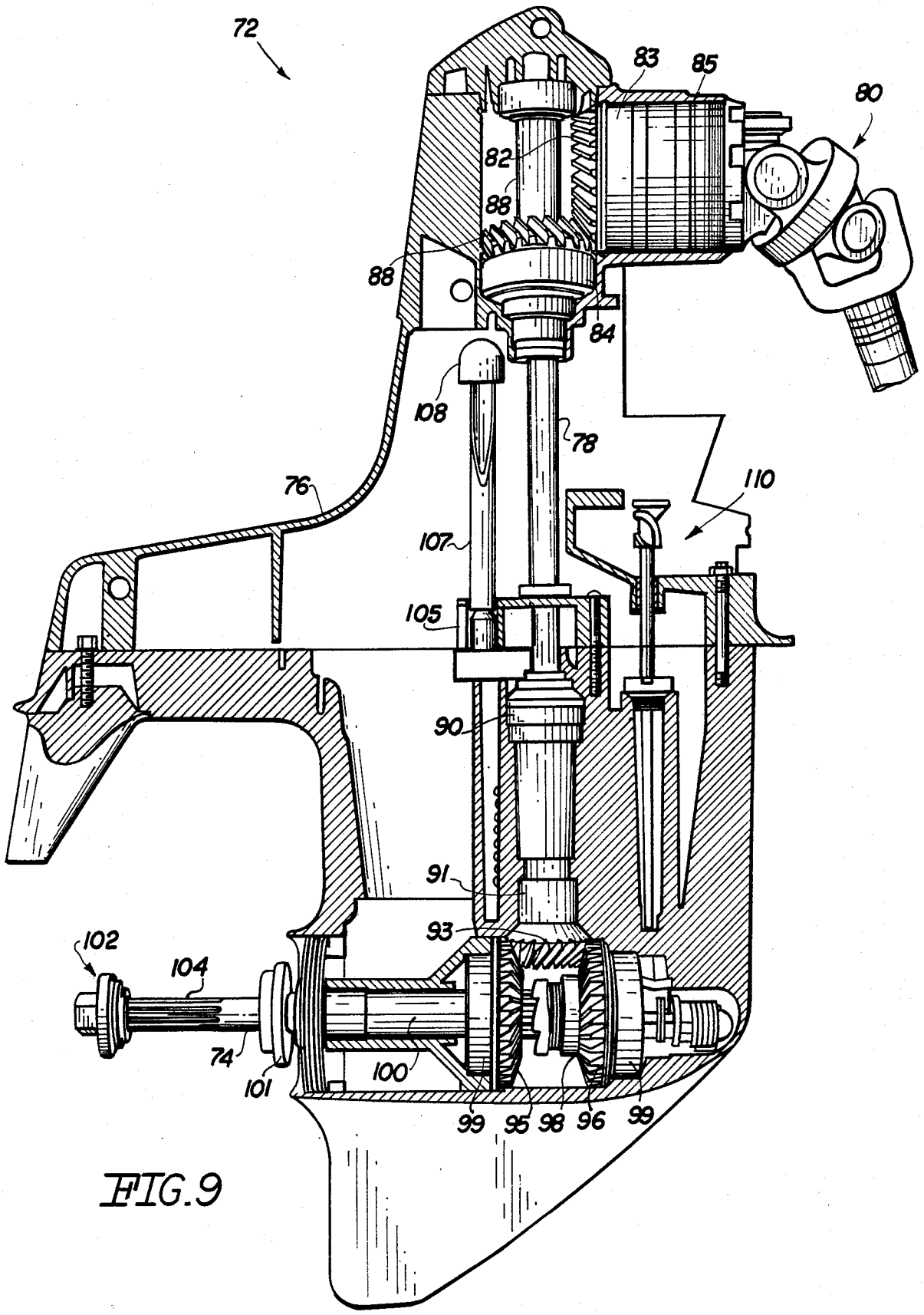
FIG. 9 is a sectional view of a prior art outdrive system.

Again for purposes of clarity, reference is herein directed to FIG. 9 representing a prior art outdrive system generally indicated as 72. A relatively detailed explanation of a conventional outdrive system is provided to emphasize the complexity of such outdrive systems in accomplishing the adjustment of the propeller (not shown) mounted on the propeller shaft 74 wherein such shaft 74 and accompanying attached propeller may be adjustably disposed to accomplish the aforementioned optimum positioning of the driving propeller dependent upon the intended load and performance characteristics of the craft during its operation. All of the above is accomplished with the present invention through the much simplified provision of a heavy duty diesel type engine 12 mounted in facing relation to the stern 24 and interconnected to a single straight line angularly oriented drive shaft 16 specifically penetrating the transom 22 of the craft (see FIGS. 7 and 8) so as to readily position the driving propeller 18 in the aforementioned optimum position. Further, the resulting torque from the high powered diesel engine 12 can be accommodated by the drive shaft 16. To the contrary, the outdrive system 72 in FIG. 9 would be incapable of maintaining such torque output produced by heavy duty diesel engines. Reliability of the subject invention is therefore a serious factor.

Again with reference to FIG. 9, the outdrive system 70 includes the housing 76, a central drive shaft 78 attached at its uppermost end to a universal joint assembly generally indicated as 80 which in turn includes a drive gear 82 interconnected to the universal joint assembly 80 by a bearing set 83 and oil seal cover as at 85. The upper drive shaft 86 is thereby forced to rotate due to its interconnection with the driven gear 88 meshing with the drive gear 82 in a bevel-type gear assembly. An additional bearing assembly 89 serves to allow support as well as rotation to the drive shaft 78, 82. Additional drive shaft bearings 90 and 91 are provided to include additional support. A pinion gear 93 is located at the opposite end of the drive shaft 78 relative to the drive gear 82 and serves to interact with a reversing gear 95 and a forward gear 96 again through a bevel-type arrangement as clearly shown. A sliding clutch 98 is provided to accomplish interengagement of the pinion gear 93 with the various drive gears and an additional bearing assembly 99 is provided in association with each of the reversing gear and forward gear 95 and 96 respectively to provide proper rotational support. A bearing carrier shaft 100 is provided as shown and serves to interconnect the propeller shaft having thrust hub 101 attached to the propeller shaft and spaced from the connector assembly generally indicated as 102. The connector assembly and spline exterior surface 104 of the propeller shaft 74 are of course provided to fixedly mount a drive propeller thereon in a manner which will accomplish rotation of the propeller with the propeller shaft 74. Other features of the relatively complex outdrive assembly includes water pump 105 communicating with the water tube 107 which terminates in a water cap or pocket 108. Finally, a shift shaft assembly is generally indicated as 110. All of the above components are necessary to accomplish the adjustable feature of selectively positioning the propeller shaft 74 and accordingly any drive propeller thereon in the aforementioned optimum position. However, such assembly could not adapt to the high torque output commonly associated with the preferred diesel engine wherein such diesel engine provides the advantage of reliability, relative economy as well as high performance.

Figure 10:
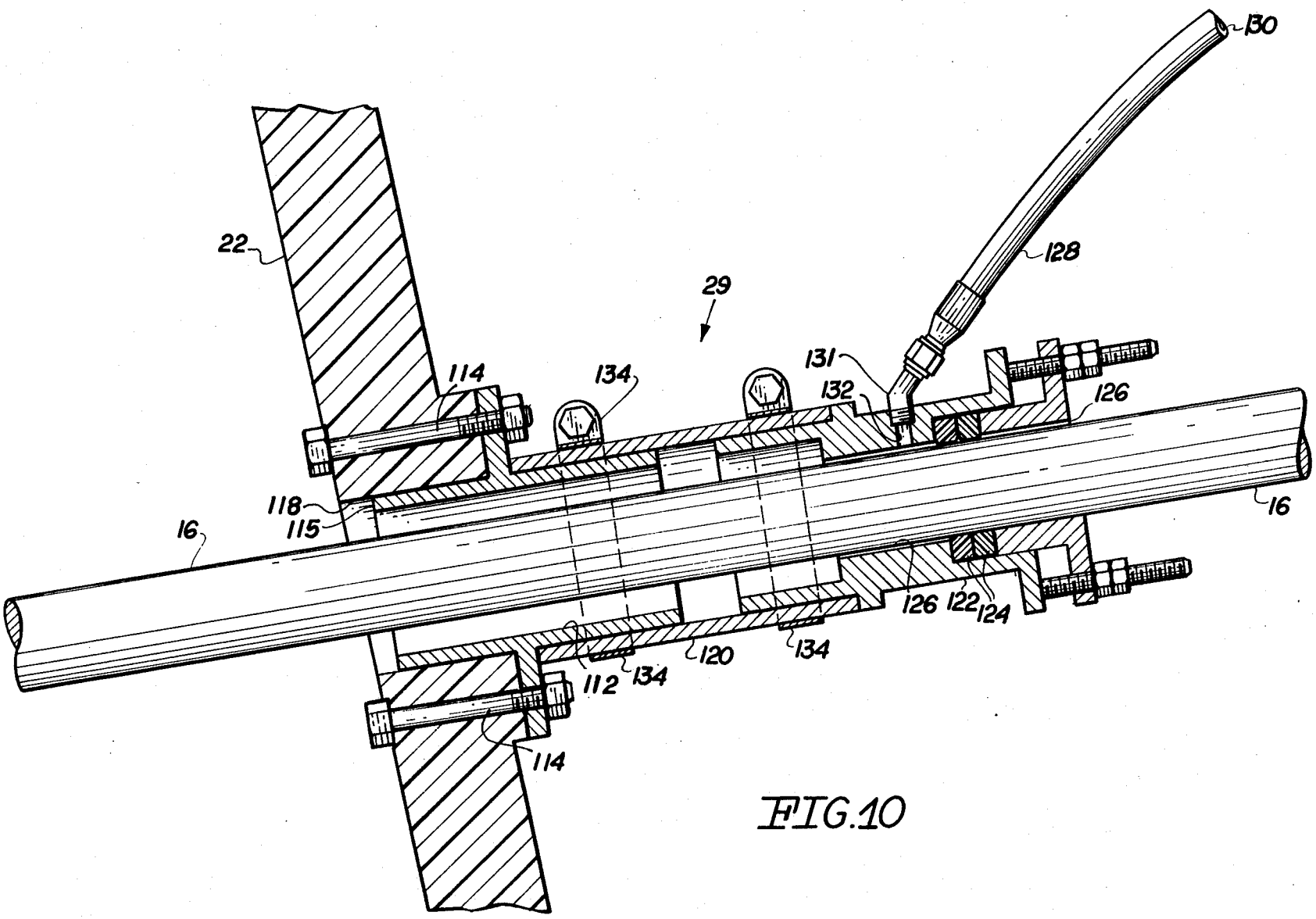
FIG. 10 is a sectional view in partial cutaway of a water irrigated and cooled shaft log used to rotatably support the drive shafts as they penetrate and extend outwardly from the transom of the marine craft.

Another feature of the present invention is best shown in FIG. 10 wherein a water cooled shaft log 29 (also see FIG. 1) is provided to rotatably support each of the drive shafts 16 and 16' as they penetrate or pass through the transom 22. The shaft log assembly 29 includes a mounting sleeve 112 bolted to the transom 22 by conventional connector elements 114 and having one end thereof as at 115 extending through a formed aperture 118 in the transom 22. A binding sleeve 120 is provided in surrounding relation to the supporting sleeve 112 and to the seal and lubricating bushing 122. Bushing 122 closely surrounds the shaft 16 and includes bearing and seal members 124 in the form of rings axially engaging the exterior surface of the shaft 16 as it rotates. A specifically dimensioned space 126 is provided between the exterior surface of the drive shaft 16 and the interior surface of the bushing 122 so as to allow free flow of water into contact with the shaft and the seal and bearing assembly 124 thereby cooling and lubricating the shaft and bearing assembly 16 and 124 respectively during high speed rotation of the drive shaft 16. Water is supplied by a conventional conduit mechanism 128 having one end as at 130 connected to a water supply or pump. Clearly, the water supply may be a salt water supply wherein such water supply is fed to the irrigating bushing 122 as by nozzle 131 through an appropriately disposed aperture 132. Common strap or belt-type connectors 134 may be disposed in surrounding relation to the connecting sleeve 120 for purposes of fixedly and firmly attaching the connecting sleeve 120 between the supporting sleeve 112 and the irrigating bushing 122.

It is therefore to be understood that the following claims are intended to cover all of the generic and specific features of the invention herein described, and all statements of the scope of the invention which as a matter of language, might be said to fall therebetween.

Now that the invention has been described, what is claimed is:

1. An inboard drive system for a marine craft comprising in combination:

(a) two drive engines mounted inboard of said craft in spaced relation from a stern portion thereof and in speed and substantially adjacent relation to a center of gravity of said craft, (b) a power take-off coupling mounted on each of said drive engines on substantially one end thereof, said power take-off coupling and said one end of said drive engines disposed in facing relation to the stern portion of the craft, (c) drive shaft means for drivingly interconnecting a propeller means to said drive engines and comprising two drive shafts of one piece construction , each connected at one proximal inboard end thereof to a respective one of said power take-off couplings associated with said respective drive engines when extending outwardly therefrom through a transom of the craft, (d) said propeller means comprising two drive propellers each secured to a distal end of a different one of said drive shafts, said drive shafts each disposed at an angular orientation relative to a longitudinal axis of the craft sufficient to dispose said propellers in a surface piercing orientation during travel of the craft, (e) support means comprising two support struts each fixedly secured to and extending outwardly from the transom of the craft and outboard thereof in substantially depending position, each of said support struts rotatably supporting one of said distal ends of one of said respective drive shafts substantially adjacent said propeller means, (f) steering strut means mounted to the transom of the craft outboard thereof for support of a steering assembly and a rudder assembly thereon and including a support arm disposed between said two support struts and spaced therefrom and a housing secured to one end of said support arm and disposed in transverse relation thereto, (g) said housing substantially enclosing said steering assembly and having said rudder assembly depending downwardly therefrom, said rudder assembly comprising two rudders each disposed in spaced relation to one another and in aligned relation to one of said drive propellers and operatively connected to said steering assembly, and (h) said support strut means secured to the transom in spaced apart relation to said housing and structured independently of said steering strut means for independent and aligned placement of said propeller means relative to said two rudders and for independent securement of said support struts in relation to said steering strut means on said transom.

2. A drive system as in claim 1 wherein said two drive shafts are each disposed in a predetermined angular orientation relative to the longitudinal axis of the craft and in spaced substantially parallel relation to one another; said support arm and said housing defining said steering strut means to include a substantially T-shaped configuration being fixedly mounted rearwardly of the transom and in structurally independent relation to respective ones of the drive shafts and support struts secured thereto.

3. A system as in claim 1 wherein each of said drive engines further include a standard transmission means drivingly interconnected thereto and disposed for driving interconnection between respective ones of said drive engines and said respective drive shafts, each of said drive engines being oriented for mounting of said standard transmission in facing relation to the stern of the craft.

4. A system as in claim 3 wherein each of said standard transmissions disposed in a substantially straight line orientation and is absent any V-drive configuration between said drive engines and said propeller means.

5. A system as in claim 1 wherein said steering means is operatively mounted on said steeting strut means and includes a tiller arm means, tie bar means and steering activation means.

6. A system as in claim 1 wherein each of said drive engines comprises a diesel engine and each of aid drive shafts associated therewith are specifically structured to accommodate the high torque output requirements of said respective diesel drive engines.

* * * * *